US005098166A

United States Patent [19]

Ebner et al.

[11] Patent Number: 5,098,166

[45] Date of Patent: Mar. 24, 1992

[54] DEVICE FOR FEEDING FLUID FOR THE SPRAYING OF PICKS IN A SHEARING DRUM

[75] Inventors: Bernhard Ebner, Knittelfeld; Otto Krassnitzer, Zeltweg; Franz Schöffmann, Zeltweg; Alfred Zitz, Zeltweg, all of Austria

[73] Assignee: Voest-Alpine Zeltweg Gesellschaft, m.b.H., Linz, Austria

[21] Appl. No.: 522,898

[22] Filed: May 14, 1990

[30] Foreign Application Priority Data

May 16, 1989 [AT] Austria ..... 1162/89

[51] Int. Cl.[5] ..... E21C 35/22

[52] U.S. Cl. ..... 299/81; 299/89

[58] Field of Search ..... 299/80, 81, 89, 12, 299/17

[56] References Cited

U.S. PATENT DOCUMENTS 4,786,112 11/1988 Brandl ..... 299/89 X

FOREIGN PATENT DOCUMENTS 0180573 10/1985 European Pat. Off. .
3631202 9/1976 Fed. Rep. of Germany .
3235533 3/1984 Fed. Rep. of Germany ..... 299/81
3805825 9/1989 Fed. Rep. of Germany ..... 299/81
2217758 4/1989 United Kingdom .
2216158 10/1989 United Kingdom ..... 299/81

*Primary Examiner*—David J. Bagnell
*Attorney, Agent, or Firm*—Cushman, Darby & Cushman

[57] ABSTRACT

A device for feeding cooling fluid into the inside of a shearing drum. The rotary drive of the shearing drum has at least one gear reduction mechanism contained within the hollow shearing drum. Fluid lines are led into the axial region of the shearing drum via a component which is stationary and rigidly connected to the carrier of the shearing drum. The gear reduction mechanism is arranged concentric with the axis and at least one of the fluid lines is led to at least one lateral end face where the fluid line supplies a fluid distributor which in turn distributes the fluid to various jets and fluid lines.

10 Claims, 6 Drawing Sheets

DEVICE FOR FEEDING FLUID FOR THE SPRAYING OF PICKS IN A SHEARING DRUM

BACKGROUND OF THE INVENTION

1. Field of the Invention

The invention relates to a device for feeding fluid, in particular cooling water for the spraying of picks, into the inside of a shearing drum, the rotary drive of which has at least one gear reduction stage inside the hollow shearing drum.

2. Description of the Related Art

For the so-called internal spraying of picks, it has already been disclosed in conjunction with rotatingly mounted shearing heads, which differ from shearing drums in that they are much shorter in the axial direction and, unlike shearing drums, can be mounted close to their axis of rotation, to carry out water feeding via axial channels in cases in which reduction gear mechanisms or stages of such a reduction gear mechanism are arranged in the hollow shearing head itself. In the case of shearing drums, a mounting takes place over the axial length of the drum, usually at several points, the mounting usually taking place at quite a large diameter and close to the outer surface of the drum. It is known to make such shearing drums hollow and it is also known to arrange stages of a reduction gear mechanism inside such shearing drums in order to be able to keep the diameter of the drive shafts smaller. However, with most designs of drive there is no possibility for axial feeding of fluid and therefore, for shearing drums, a spraying of the picks themselves via feed lines arranged inside the shearing drum is not readily possible.

It is also known in the case of shearing drums to extend lateral regions of the shearing drums in the axial direction by hydraulically driven, extendable components, with the result that a widening of the drum is obtained. Fluid medium must likewise be fed for the hydraulic drive of such shearing drum widenings and, since the drives of such drum widenings are set in rotation with the shearing drum, rotating lead-throughs are required for the feeding of fluid. If, as is usual in the case of known drive apparatuses, a continuous shaft is used as gear output shaft, the rotating lead-through can only ever be provided outside the axial area and consequently at quite a large radius, as a result of which sealing problems arise.

SUMMARY OF THE INVENTION

The invention now relates to a device of the type mentioned at the beginning and is based on the object in the case of an arrangement in which at least one gear reduction stage is arranged inside the hollow shearing drum, of simplifying the sealing for fluid feed lines and of providing an internal spraying with which the central regions of a shearing drum remaining between bearing points of a shearing drum can also be supplied with fluid for the spraying of picks, without an excessive complexity of sealing means being necessary for this. To achieve this object, the device according to the invention consists substantially in that the fluid lines are led into the axial region of the shearing drum via a component which is fixed in place and rigidly connected to the carrier of the shearing drum, in that the gear mechanism is arranged concentric to the axis and in that at least one axial fluid line is led to at least one lateral end face and opens out into at least one distributor. In order to provide the possibility of an axial lead-through of the fluid lines, in this case a design of gear is assumed as already used in principle in the case of shearing heads. Such gear designs provide a rigid carrier for intermediate gear wheels, a simple fluid feed being permitted by means of such a rigid carrier. With a simply single-staged reduction, the output occurs in the case of such intermediate gear mechanisms with rigid carrier of the intermediate gear wheels via the internal gear wheel of the mechanism, it being possible in a simple way for such an intermediate gear mechanism with rigid carrier of the intermediate gear wheels to be combined with downstream planetary gear mechanisms, which still permit an axial lead-through of the fluid lines. What is essential here for reliable and simple sealing is that the fluid lines are led into the axial region of the shearing drum via a component which is fixed in place and rigidly connected to the carrier of the shearing drum, and that at least one axial fluid line is led to at least one lateral end face and opens out into at least one distributor. The arrangement of distributors in or on the end face of such a drum facilitates the accessibility of the seals and such seals are only necessary at the periphery of the axial fluid line rigidly connected to the rigid component. Since such fluid lines only have to have a small diameter, a reliable seal can be readily accomplished here. Starting from such distributors, fluid can then be led via channels, for example to the nozzles of the pick spraying or to other units, such as for example drive units for shearing drum widenings, it being quite possible for the further channels to be arranged in components which co-rotate with the drum. However, the distributor close to the lateral end face can also be equipped in a way known in the case of shearing heads as a device for intermittent spraying, the distributor being able to interrupt the fluid stream intermittently at the nozzles to achieve fluid pulses, and it is furthermore quite possible to provide a so-called sector control, with which it is to be ensured that only the parts of the shearing drum towards the heading face are supplied with fluid. For pick cooling it is known to use water or water-air mixtures as fluid, it being possible even in the present case to use any desired media such as are employed for pick cooling or dust suppression A simply designed configuration of a gear mechanism which permits such an axial lead-through inside a hollow shearing drum is described below.

The design according to the invention is advantageously arranged such that the axial fluid line has at least two separate channels. Unlike rotating lines, a fluid line which is fixed in place and rigidly connected to the carrier of the shearing drum can be connected to the rigid component without any appreciable sealing problems and, due to the measure that a multiplicity of such channels are provided, a differentiated control of individual units inside the shearing drum as well as a differentiated control of the spraying from outside can also be set.

By means of such an axial fluid line which is connected in a rotationally fixed manner to the rigid part and has a multiplicity of channels, even complicated distributors can be connected close to the end faces of the shearing drum without any appreciable sealing problems, and the design is advantageously arranged such that a distributor is in each case arranged for the fluid in a way known per se close to the lateral end faces and that to at least one distributor there are connected lines co-rotating with the central regions of the drum, arranged between carriers, said lines leading to nozzles in these regions of the drum. A simple feeding to central regions of the drum is possible in particular via such lines co-rotating with the drum, with the result that the central region of a drum remaining between the mountings can also be equipped with internal spraying in a simple way. Wearing parts contained in the distributor can be made easily accessible for maintenance work on account of the arrangement close to the end faces of the drum and, with the arrangement according to the invention, the pulse frequency desired in a particular case for a pulse control can be altered by simple exchange of slotted discs or the like.

By means of multi-channel axial fluid lines it is also possible to control various functions and the design is advantageously arranged such that nozzles to picks and/or control drives for drum widenings are connected to the axial fluid lines. In principle, different media can be transported in the individual channels of the fluid lines, but the drive for drum widenings can also readily be controlled with the same fluid which is used for spraying the picks.

A particularly advantageous design of such a rigid fluid line equipped with separate channels can be brought about by the fluid line being designed as a multi-walled pipe which is rigidly connected to the fixed-in-place component and the mutually separate spaces of which are connected to separate supply lines or discharge lines. The feeding to such a fluid line designed as a multi-walled pipe takes place still in the stationary fixed or fixed-in-place part and with this feeding there are therefore no sealing problems, as would occur in the case of parts rotating relatively to one another. As already mentioned, the distributor itself may be designed in a way known per se as a sector or pulse control, it being possible to take a pulse control suitable for shearing heads as well as a corresponding sector control for shearing heads from, for example, the older application A 1097/88. Such sector controls are suitable in particular for high pressures and consequently high pulse pressure peaks.

In principle, if the fluid line is designed with two channels, it is possible to connect them in such a way that the delivery line for feeding fluid to the nozzles is connected to the working space of a cylinder-piston unit for the actuation of a shearing drum widening and that the cylinder space opposite the said working space is connected to a separate discharge line. In this way, whenever the spraying of the picks is activated, at the same time a fluid under pressure is also fed to the drive for the shearing drum widening, with the result that a lateral extending movement is initiated at the same time as spraying. The second channel of the fluid line is in this case required to retract the drum widening again for moving the shearing machine along, and for this purpose only the discharge line connected to the second cylinder space has to be connected to a pressure source, whereupon the original pressure medium feed line is switched to become a discharge line. However, such a connection can be altered outside the rotating drum and consequently outside the machine itself. More complex controls can naturally be brought about if valve arrangements are provided or a multiplicity of separate channels are provided in the fluid line, which, in consideration of the stationary fluid line, is likewise possible however without appreciable sealing problems. The design is in this case advantageously arranged such that a valve arrangement for supplying drives of a shearing drum widening is connected to at least one fluid line, as a result of which the number of necessary line channels can be minimized.

A feeding of fluid under pressure to the nozzles of the picks in the central region of the drum, as remains for example between bearing points on the jib, can be accomplished by the lines which return to the central region of the drum and co-rotate with the drum opening out in an annular collecting channel component connected to the central part of the drum. The annular collecting channel component in this case allows the use of simple pipes inside the hollow shearing drum and a high operational reliability is provided by the possibility of supporting such collecting channel components on the axial fluid line. In order to prevent oscillations in the pipelines, a multiplicity of such supports can be provided over the axial length of the axial fixed-in-place fluid line, the design being advantageously arranged, for the collecting channel component in particular, such that the collecting channel component is rotatably mounted on the axial fixed-in-place fluid line.

BRIEF DESCRIPTION OF THE DRAWINGS

The invention is explained in more detail below with reference to exemplary embodiments diagrammatically represented in the drawing. In the said drawing.

DETAILED DESCRIPTION OF THE PREFERRED EMBODIMENT

Figure 1:
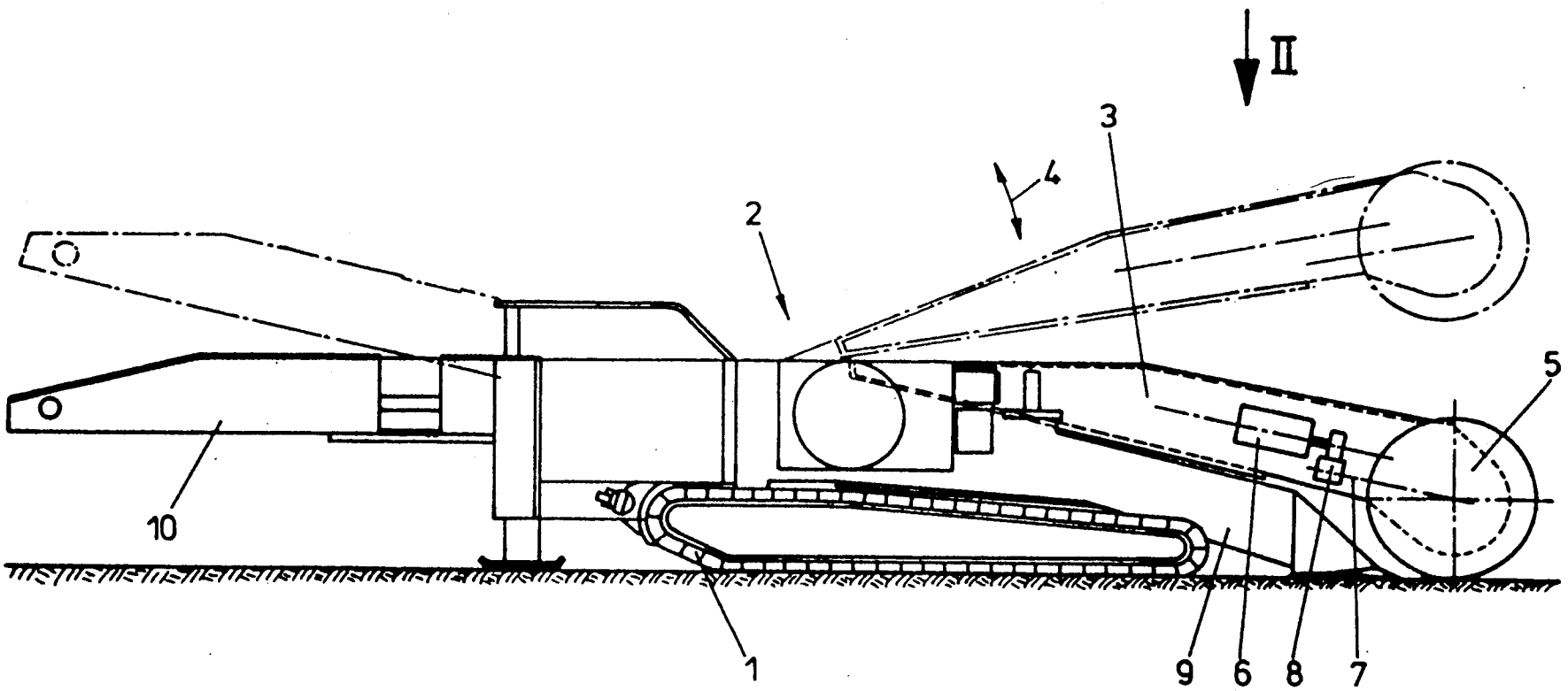
FIG. 1 shows a diagrammatic side view of a drum shearing machine.

In FIG. 1, a shearing machine 2 which can be moved along on a crawler undercarriage 1 is shown, a rotatably mounted shearing drum 5 being arranged on a supporting arm 3 and able to luff in the direction of the double-headed arrow 4. The drive motor for the rotary drive of the shearing drum 5 is diagrammatically indicated by 6, the motor shaft lying axially parallel to the drive shaft 7 and being connected to the said drive shaft 7 via a first gear mechanism 8. The drive shaft 7 opens out in the region of the carriers of the drum 5 into the inside of the shearing drum 5, as explained in further detail below.

In the representation according to FIG. 1, the drum shearing machine 2 also has a loading device 9, formed by a ramp, and a vertically adjustable conveyor 10 is diagrammatically indicated at the rear end of the machine.

Figure 2:
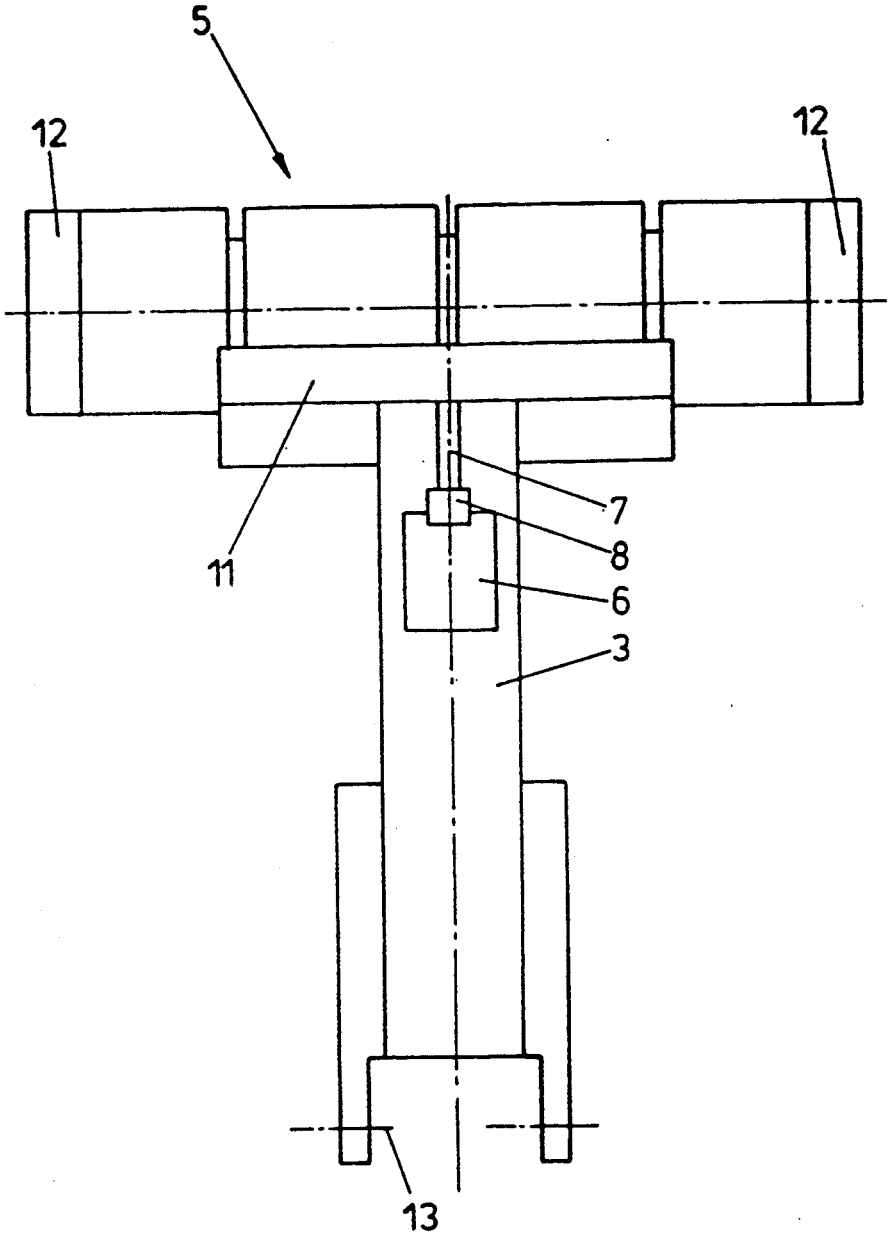
FIG. 2 shows a plan view in the direction of the arrow II of FIG. 1 of the jib of the drum shearing machine.

In the representation according to FIG. 2, it can be seen that the shearing drum 5 is mounted on the supporting arm 3, the mounting of the supporting arm being diagrammatically indicated by 11. Arranged in turn inside the supporting arm 3 is the drive motor 6 and the gear mechanism 8, and the transmission of movement takes place by means of a single common drive shaft 7 into the inside of the shearing drum 5. The shearing drum 5 has in this case inner regions, which lie inside the mounting 11, and lateral regions, which project beyond the mounting 11 and which may comprise for example a diagrammatically indicated drum widening 12. The luffing of the shearing arm 3 is carried out by means of the substantially horizontal swivel axis indicated by 13.

Figure 3:
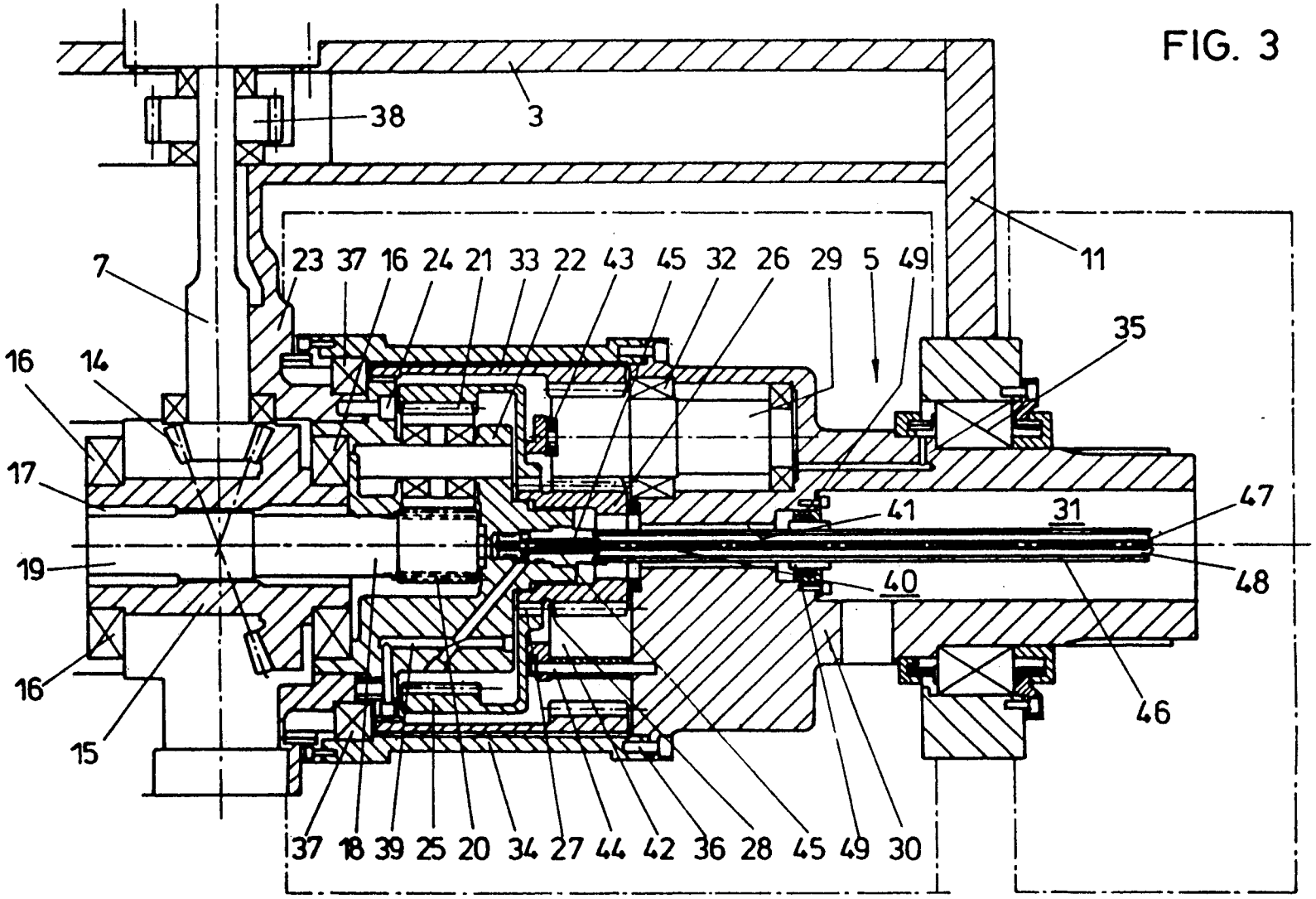
FIG. 3 shows an enlarged representation of a reduction gear mechanism which is arranged inside the shearing drum of hollow design and is for leading through or feeding axial fluid lines inside a hollow shearing drum.

The gear mechanism for the drive of the shearing drum is illustrated in FIG. 3. In FIG. 3, the common drive shaft is in turn denoted by 7 and is equipped with a bevel gear wheel 14. Inside the shearing drum 5, a first bevel gear wheel 15 is rotatably mounted, the mounting being denoted diagrammatically by 16 and supported in a rigid housing part. The first bevel gear wheel 15 mounted in this way inside the shearing drum 5 has an internal gearing 17, into which overhung shaft stubs 18 and 19 enter. The two shaft stubs 18, 19 are of substantially identical design, the further gear reduction described in more detail below for the shaft stub 18 applying analogously and symmetrically also to the further arrangement which follows the shaft stub 19 but is not shown. The shaft stub 18 has at its free end a sun wheel gearing 20, which meshes with the gearing of intermediate gear wheels 21. The intermediate gear wheels 21 are rotatably mounted on a rigid carrier 22, the rigid carrier 22 being connected to the rigid housing part 23, for example by a screw joint 24. The rigid carrier 22 with the intermediate gear wheels 21 is enclosed by an internal gear wheel 25, which internal gear wheel 25 is in turn connected in a rotationally fixed manner to the sun gear wheel 26 of a downstream planetary gear mechanism. The connection of the internal gear wheel 25 to the sun gear wheel 26 is carried out by means of a gearing 27, which is separated from the external gearing of the sun gear wheel 26 by a peripheral groove 28. The flanks of the external gearing of the sun gear wheel 26 are in engagement with the gearing of planetary gear wheels 29 and the carrier of these planetary gear wheels 29 is integrally connected to the output part 30 of the gear mechanism of the shearing drum, the basic body of the shearing drum being connected on the outside in a rotationally fixed manner to the output part 30 by means of a splined shaft connection and the inner shaft parts being connected in a rotationally fixed manner to the same output part 30 by means of a connection formed, for example, by a square. The output part of this shearing drum 30 is designed hollow inside, the hollow space extending in the axial direction being indicated diagrammatically by 31. The planetary gear wheels 29 are mounted via bearings 32 in the output part 30 of the shearing drum 5, the output part 30 thus directly forming the carrier of the planetary gear wheels 29. The outer wall of the shearing drum 5 connected to the output part 30 has the picks (not shown in FIG. 3) which can be brought into engagement with the material to be extracted and the outer contour of which is indicated in broken lines. In order then to transmit the rotary movement of the sun gear wheel 26 onto the output part 30 of the planetary gear wheels 29, a further internal gear wheel is also necessary, this further internal gear wheel 33 being connected in a rotationally fixed manner to the carrier 22 of the intermediate gear wheels. The internal gear wheel, which is fixed in place and connected in a rotationally fixed manner to the carrier of the intermediate gear wheels, is covered on the outside by a shearing drum part 34 connected to the output part 30,. with the result that picks which can be set in rotation together with the output part 30 of the shearing drum can be arranged in this region as well. The shearing drum may be supported in the region of the output part 30 via bearing 35 on a part of the mounting 11 of the supporting arm 3, the wall part 34 of the shearing drum 5 which is connected via a screw joint 36 to the output part 30 of the shearing drum being supported via bearing 37 on the gear housing. The mounting of the drive shaft 7 on the supporting arm 3 is also diagrammatically indicated by 38.

With such a design of the reduction gear mechanism, the possibility is created of leading through the rigid carrier 22 lines 39 which open out into a region 40 close to the axis. If then, as shown in FIG. 3, the axial region of the output part 30 which forms the carrier of the planetary gear wheels 29 likewise has an axial breakthrough 41, an open connection between the feed of the lines 39 in the region 40 close to the axis and the hollow inside 31 of the shearing drum is obtained, with the result that any desired lines, such as for example fluid lines or electric lines, can be led out from the gear housing with little complexity of the sealing means. The inside of the gear housing is denoted by 42 and can be filled in a conventional way with lubricating oil, here too the complexity of the sealing means being reduced considerably on account of the relatively small areas to be sealed in the region of the axial breakthrough 41 of the output part 30 of the planetary gear wheels 29.

An axial securing of the planetary gear wheels 29 against displacement in the axial direction can be accomplished by a securing ring 43, which is connected via screws 44 to the output part 30 of the shearing drum 5, the distance between the output part 30 and the axial securing disc 43 being set by pieces of pipe.

Figure 5:
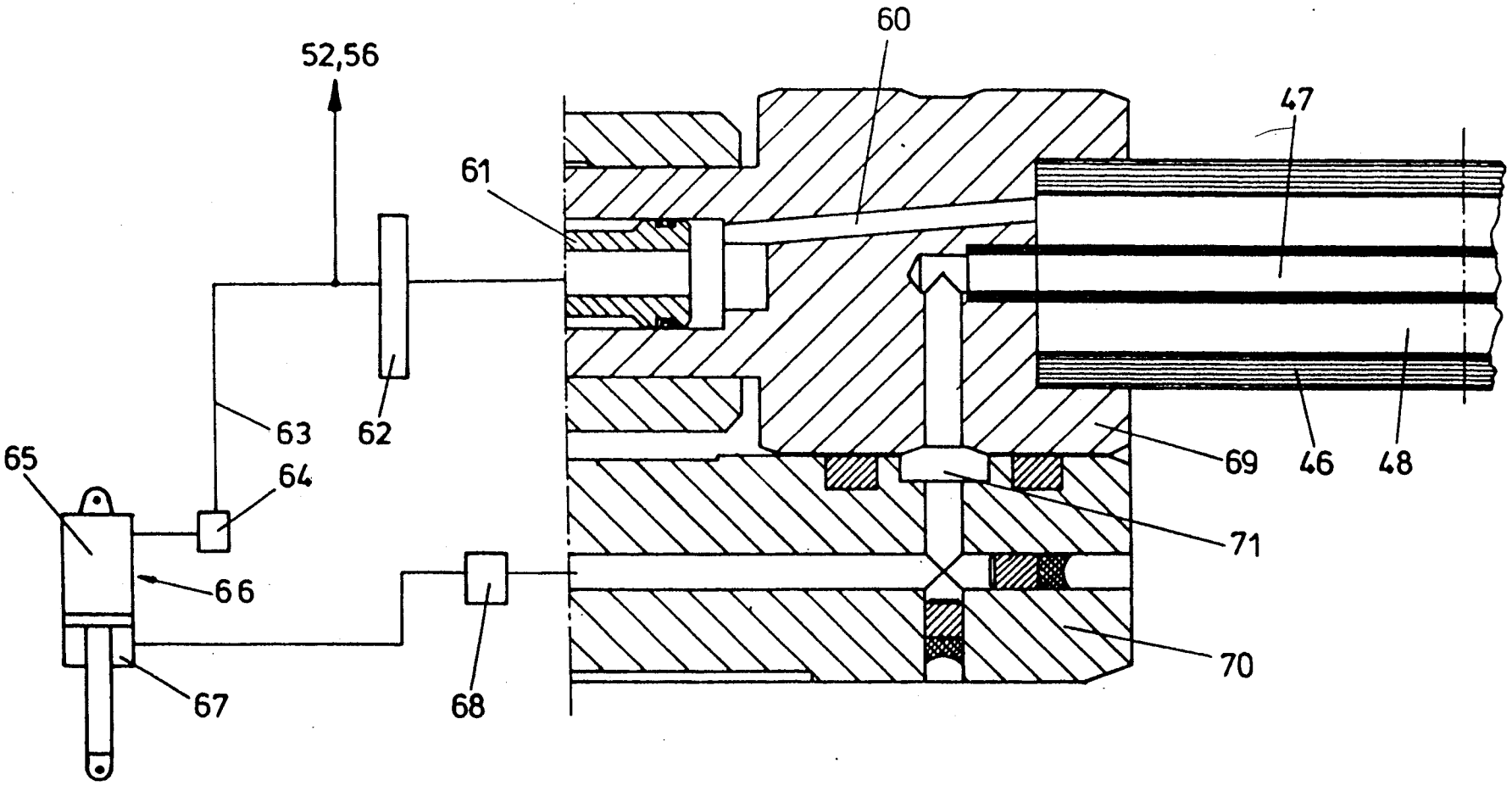
FIG. 5 shows an enlarged representation of a distributor close to the end face of a shearing drum with the possibility of supplying drives, such as for example a drive for the lateral widening of the drum.
Figure 6:
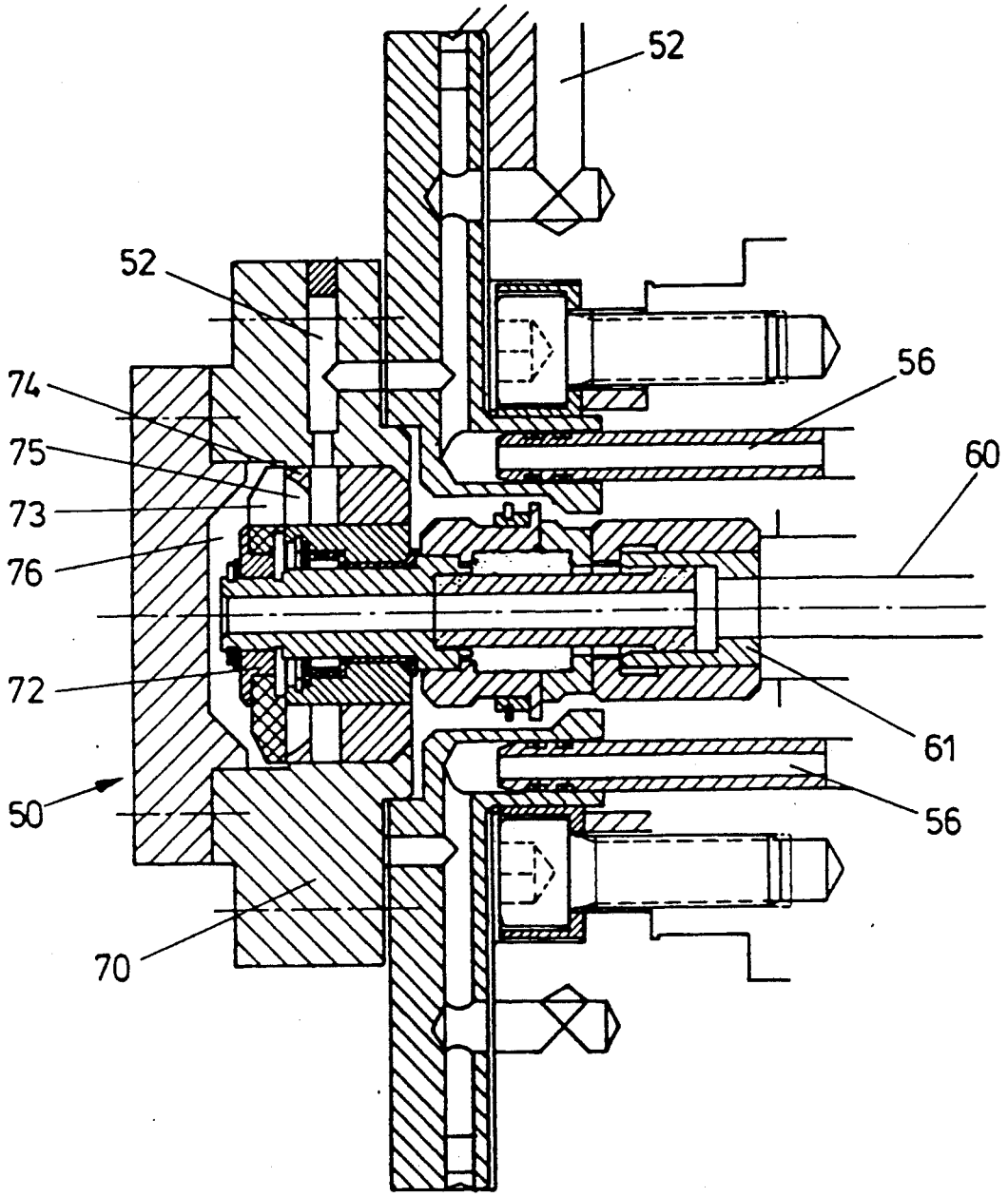
FIG. 6 shows a simplified design of a distributor, for which only one fluid supply line is necessary, since just spraying takes place, the spraying being carried out by intermittent supplying of the individual nozzles of a sector on the surface of the shearing drum towards the heading face.

The fluid supply lines 39 in this case open out in the region 40 close to the axis into a bush 45, which is fitted into the rigid part 22 and, in the case of the design according to FIG. 3, is adjoined by an axially arranged fluid line 46, which is rigidly connected to the bush 45, the fluid line 46 being designed as a multiwalled pipe which has a central channel 47 as well as a further channel 48 which surrounds the said central channel 47 and is for the feeding of fluid in two separate lines to distributors arranged in the region of the lateral end faces of the drum 5, as are described in more detail in FIGS. 5 and 6. In this arrangement, seals 49 lying at a small radius suffice between the rotatable basic body 30 and the unrotatably mounted fluid line 46.

In FIG. 4, again only half of the shearing drum 5 is represented, the supporting arm and the mounting again being denoted by 3 and 11, respectively. A fluid passes through the central and fixed fluid line 46 to a distributor 50 (not shown in any more detail in FIGS. 5 and 6) in the region of the end face 51 of the shearing drum and, starting from this distributor 50, substantially radial bores 52 lead to distribution bores 53 which are arranged in the region of the outer surface of the shearing drum and permit a spraying of, for example, cooling water in the region of the diagrammatically indicated picks 54 by means of nozzles (not shown in any more detail), as is indicated by 55. Along with the connecting bores 52 and 53 for spraying the picks on the outer shearing drum parts, lines 56 running in the axial direction lead from the distributor 50 to an annular collecting channel component 57, which is mounted rotatably about the axial fixed-in-place fluid line 46, substantially radial bores 58 leading from the collecting channel component to further distributor bores 59 in the inner region of the shearing drum, which in turn permit a spraying of the picks by means of nozzles (not shown in any more detail) in the inner sections of the shearing drum as well. The lines 56 are in this case evenly distributed over the circumference, it being possible for example for eight lines 56 to be provided for a pulse and/or sector control performed with the distributor 50, in order also to supply selectively with fluid only certain zones of the circumferential surface of the shearing drums in the inner shearing drum regions.

Figure 4:
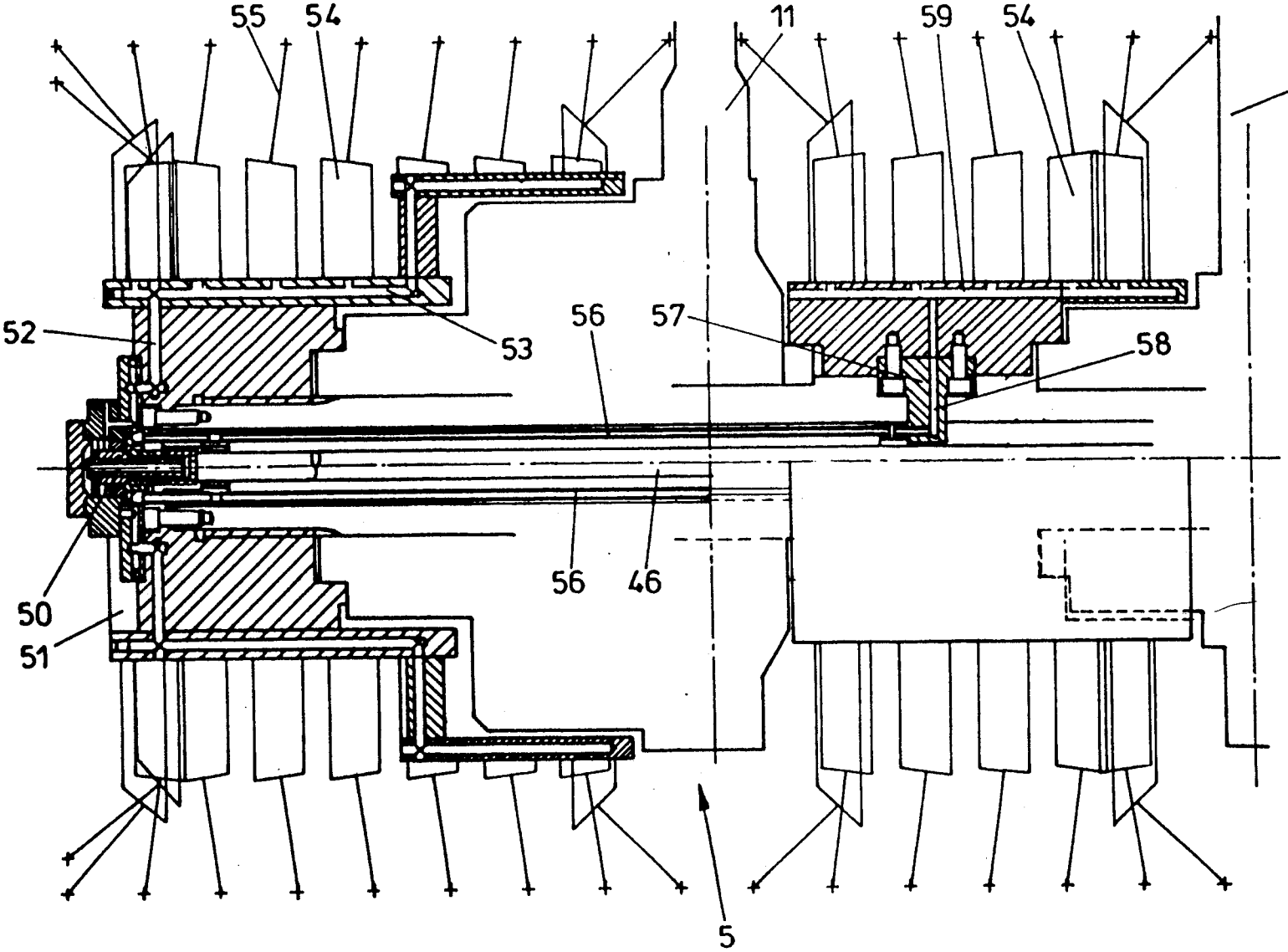
FIG. 4 shows a diagrammatic representation of the arrangement of nozzles on the outer surface of a shearing drum and the lines provided for this inside the drum.

In FIG. 5, the axial fixed-in-place line 46 is represented enlarged, which again shows the central channel 47 and the ring line 48 surrounding the said channel. This ring line 48 opens out via a bore 60 into the feed region 61 of the fixed-in-place distributor 50, as it is represented in more detail in FIG. 6, for example, in which arrangement, after the diagrammatically indicated distributor disc 62, which may be designed for example in analogy with the design of the older application A 1097/88, fluid passes from the line 48 in turn into the feed lines 52 for spraying of the outer shearing drum parts as well as into the axial feed lines 56 for spraying of the internal shearing drum parts, as is represented in FIG. 4. Furthermore, a line 63 leads via a valve arrangement 64 into a working space 65 of a diagrammatically indicated cylinder-piston unit 66, which is used as the drive for a widening of the shearing drum. After a pressure relief of the line 63, the cylinder-piston unit 66 can be brought back into its initial position by feeding fluid into the second working space 67, the feeding of fluid under pressure into the second working space 67 taking place via further valve arrangement 68 by feeding fluid from the axial channel 47 of the fixed-in-place axial line 46. The transition from the rigid housing part 69, connected to the fixed-in-place fluid line 46, into the rotatable component 70 connected to the rotating basic body of the shearing drum takes place in this case in a way known per se by means of a rotating lead-through 71 of small diameter.

In FIG. 6, the distributor 50 arranged at the face end is represented in more detail, no shearing drum widening being shown in the case of this embodiment represented. The supply line into the fixed-in-place entry region 61 of the slide may in this case be formed either by the supply line 60, as it is represented in FIG. 5, or directly by the fixed-in-place axial fluid line 46, in this exemplary embodiment there then only being one fluid line provided for spraying.

The distributor shown in FIG. 6 in this case corresponds substantially to the design of a distributor for a pulse and sector control, as is used for example for shearing heads and is described in the applicant's older application A 1097/88. The fluid fed via the line 60 or 46 passes via the fixed-in-place and unrotatably mounted part of the distributor via a distributor disc 72 into the lines 52 to the outer shearing drum parts as well as into the lines 56 which run in the axial direction of the shearing drum and permit a spraying of the central sections of the shearing drum, as is indicated in FIG. 4.

The implementation of the pulse and sector control is in this case carried out in such a way that the fixed-in-place disc 72 of the distributor has radial slots 73 at its periphery and that directly behind the disc 72 there is provided a further disc 74 with likewise radial slots 75, the second disc 74 being connected to the rotational part 70 of the basic body of the shearing drum. The turning of the part 70 with the disc 74 causes the slots 73 and 75 to pass over each other, a pulse control thereby being accomplished. The following sector control is in this case carried out in such a way that the slots 73 in the fixed disc 72 of the distributor extend only over a certain angle at circumference, with the result that a connection between the supply line 60 via the space 76 through the slots 73 or 75 of the discs into the bores 52 arranged in the rotatable part 70 is permitted only over a restricted circumferential area. In this way, an intermittent and sector-controlled spraying of the internal parts of the shearing drum also takes place in each case only via the corresponding lines 56 assigned to the restricted circumferential area.

We claim:

1. A device for supplying cooling fluid to picks located on a shearing drum, comprising:

a substantially cylindrical shearing drum with at least one lateral end face, said shearing drum extending across substantially the entire width of a mining face to be mined, said picks being located on the exterior of said drum along substantially its entire length;

rotary drive means located inside said shearing drum substantially centrally of the length of said drum, said rotary drive means having at least one gear reduction stage, said gear reduction stage being arranged concentric to an axis of said shearing drum;

means, including a rigid carrier, for rotatably supporting said shearing drum at a plurality of points intermediate the ends of said shearing drum;

a plurality of fluid lines extending into an axial region of said shearing drum, said fluid lines passing through a central portion of said drive means; and means for fixing said fluid liens to said rigid carrier, at least one of said fluid lines entering said shearing drum through said rigid carrier and terminating at fluid distributor means located at said lateral end face of said shearing drum and extending axially of said drum for distributing cooling fluid to picks along the length of said drum.

2. A device for supplying cooling fluid to picks located on a shearing drum, comprising:

a substantially cylindrical shearing drum with at least one lateral end face, said shearing drum extending across substantially the entire width of a mining face to be mined;

rotary drive means located inside said shearing drum, said rotary drive means having at least one gear reduction stage, said gear reduction stage being arranged concentric to an axis of said shearing drum;

means including a rigid carrier for supporting said shearing drum;

a plurality of fluid lines, each having at least two mutually separate passages, extending into an axial region of said shearing drum; and means for fixing said fluid liens to said rigid carrier, at least one of said fluid liens entering said shearing drum through said rigid carrier and terminating at fluid distributor means located at said lateral end face of said shearing drum.

3. A device according to claim 1 or 2, wherein said distributor means includes a fluid distributor arranged adjacent to the lateral end face and wherein said distributor is connected to auxiliary fluid lines, said auxiliary fluid lines being capable of concentrically rotating with central regions of said drum, said auxiliary fluid lines leading to nozzles located at predetermined regions of said drum.

4. A device according to claim 3 wherein said nozzles are in communication with said auxiliary fluid lines.

5. A device according to claim 3, wherein said auxiliary fluid liens for feeding fluid to said nozzles are connected to a cylinder-piston unit, said cylinder piston unit having first and second working cylinders on opposite sides of a piston for actuation of a shearing drum widening means and wherein said cylinder piston unit is also connected to a separate discharge line.

6. A device according to claim 2, wherein each of said fluid lines is a pipe with a plurality of walls defining said mutually separate passages and wherein said mutually separate passages are connected to respective supply and discharge lines.

7. A device according to claim 1 or 2, wherein said fluid distributor means includes a fluid distributor having at least one of a sector and a pulse control.

8. A device according to claim 2, wherein a valve arrangement for supplying drives of a shearing drum widening means is connected to at least one of said passages.

9. A device according to claim 1 or 2, wherein said fluid distributor means includes auxiliary fluid lines extending to a central region of said shearing drum, said auxiliary fluid lines being capable of rotating concentrically with said shearing drum, said auxiliary fluid lines communicating with an annular collecting channel joined by radial bores leading to nozzles located at said central region of said drum.

10. A device according to claim 9, wherein said collecting channel is rotatably mounted about said fixed fluid lines.

* * * * *